US008146180B2

(12) United States Patent
Thurin et al.

(10) Patent No.: US 8,146,180 B2
(45) Date of Patent: Apr. 3, 2012

(54) TOILET TABLET DISPENSER

(75) Inventors: Matthew N. Thurin, Wauwatosa, WI (US); Douglas A. Soller, Racine, WI (US); Michael C. Fryan, Racine, WI (US); Kevin L. Askling, Madison, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 381 days.

(21) Appl. No.: 12/404,515

(22) Filed: Mar. 16, 2009

(65) Prior Publication Data

US 2009/0241247 A1 Oct. 1, 2009

Related U.S. Application Data

(60) Provisional application No. 61/039,234, filed on Mar. 25, 2008.

(51) Int. Cl.
*E03D 9/02* (2006.01)

(52) U.S. Cl. ..... 4/230; 4/223

(58) Field of Classification Search ..... 4/229, 230, 4/222, 223

See application file for complete search history.

(56) References Cited

U.S. PATENT DOCUMENTS

| | | | |
|---|---|---|---|
| 713,978 | A | 11/1902 | Gallagher |
| 749,963 | A | 1/1904 | Gallagher |
| 979,386 | A | 12/1910 | Druzbach |
| 988,178 | A | 3/1911 | Druzbach |
| 2,245,066 | A | 6/1941 | Bouchard |
| 2,993,214 | A | 7/1961 | Franco |
| 3,001,210 | A | 9/1961 | Diehl |
| 3,410,455 | A | 11/1968 | Haas |
| 3,840,914 | A | 10/1974 | Tufts et al. |
| 3,845,882 | A | 11/1974 | Hass |
| 3,942,683 | A | 3/1976 | Haas |
| 3,968,902 | A | 7/1976 | Bachmann |

(Continued)

FOREIGN PATENT DOCUMENTS

DE 2851139 A1 6/1980

(Continued)

OTHER PUBLICATIONS

Translation of Burette (EP 1505215) from European Patent Office, powered by google translate.*

(Continued)

*Primary Examiner* — Brian Glessner
*Assistant Examiner* — Brian D Mattei

(57) ABSTRACT

Devices for dispensing toilet treatment tablets into toilet bowls when a button is actuated are disclosed. In one version, the device includes: (i) a toilet cover; (ii) a dispenser mounted to the cover; (iii) a plurality of solid tablets stored in the dispenser so as to be dispensable therefrom, wherein at least one of the tablets includes a toilet treatment chemical; and (iv) an actuator for moving a tablet from a ready position of the dispenser to a release position. In another version, the invention provides a handheld device including a body having a cover and a hollow wall connected to the cover. The cover and the wall define an interior space in the body, and the cover includes a dispensing slot. The device also includes a removable tablet holder suitable for holding a plurality of solid tablets. A tablet retainer of the tablet holder is located within the cover when the tablet holder is installed within the body. The tablet retainer retains a tablet in a ready position for dispensing. An actuator is disposed in the cover for moving a tablet from the ready position out through the dispensing slot.

5 Claims, 11 Drawing Sheets

U.S. PATENT DOCUMENTS

| | | | |
|---|---|---|---|
| 4,171,753 | A | 10/1979 | Vreede |
| 4,216,553 | A | 8/1980 | Haberle |
| 4,819,276 | A | 4/1989 | Stevens |
| 4,966,305 | A | 10/1990 | Hinterreiter |
| 5,040,246 | A | 8/1991 | Zanino |
| 5,071,033 | A | 12/1991 | Siwek |
| 5,566,857 | A | 10/1996 | Rothman |
| 5,785,206 | A | 7/1998 | Chan |
| 5,984,285 | A | 11/1999 | Konig et al. |
| 6,745,417 | B2 | 6/2004 | Sumino |
| 7,117,549 | B1 | 10/2006 | Hannigan |
| 2002/0038806 | A1 | 4/2002 | Senda |
| 2006/0097189 | A1 | 5/2006 | Lim |
| 2008/0244813 | A1 * | 10/2008 | Looft ..... 4/223 |
| 2009/0056004 | A1 * | 3/2009 | Soller et al. ..... 4/223 |

FOREIGN PATENT DOCUMENTS

| | | | |
|---|---|---|---|
| DE | 102005001794 | A1 | 4/2006 |
| EP | 1505215 | A | 2/2005 |

OTHER PUBLICATIONS

International Search Report and Written Opinion dated Apr. 16, 2010 Appl No. PCT/US2009/001697.

* cited by examiner

TOILET TABLET DISPENSER

CROSS-REFERENCES TO RELATED APPLICATIONS

This application claims priority based on U.S. provisional application 61/039,234, filed Mar. 25, 2008.

STATEMENT REGARDING FEDERALLY SPONSORED RESEARCH

Not Applicable.

BACKGROUND OF THE INVENTION

The present invention relates to devices for dispensing toilet bowl treating chemicals (e.g. cleaners, disinfectants, deodorizers, etc.). More specifically, it relates to devices that allow a consumer to direct a toilet treatment tablet into the toilet bowl when a button is actuated.

Toilet bowls require care to prevent the buildup of unsightly deposits, to reduce odors and to prevent bacteria growth. Traditionally, toilet bowls have been cleaned, deodorized and/or disinfected by manual scrubbing with a liquid or powdered cleaning/sanitizing agent that is added to the bowl water by hand. This task has required manual labor to keep the toilet bowl clean.

To reduce or in some cases eliminate the need for such manual scrubbing, various automatic toilet bowl cleaning systems have been proposed. One type of system delivers the cleaning chemical by adding it to the flush water while the flush water is still stored in the toilet tank. Some embodiments of this type of system add the chemical to the flushing cycle in liquid form. Others place a block of cleaning chemical in the toilet tank, to slowly dissolve over several weeks or longer.

However, in systems which rely on adding the chemical to the toilet tank, precise control over the quantity of chemical to be delivered may be difficult. For example, different water hardness from the supply may cause different cleaning blocks to dilute at different rates. Further, the objective is to keep the toilet bowl clean, not the water holding tank. Since all the cleaner is dispensed into the toilet tank, rather than the toilet bowl, much of the cleaner may be flushed down the drain without cleaning the toilet bowl at all.

An alternative type of system hangs a dispenser adjacent and/or immediately under the toilet bowl rim. Water flowing from the rim washes over the dispenser, thereby triggering dispensing of the stored chemical directly into the bowl water. However, some consumers may prefer not to have the ornamental exterior of their toilet disrupted by the presence of a hook hanger.

In any event, such systems are designed to dispense in response to each flush. In some situations where increased amounts of flushing are occurring (e.g., a large number of guests) cleaning chemicals may not be necessary after every flushing. Thus, some of these systems may use up more cleaning chemicals than is actually needed.

There have been attempts to associate toilet bowl chemical dispensers with the lids or other coverings of toilets, or near them. See, for example, U.S. Pat. Nos. 713,978, 749,963, 979,386, 988,178, 3,840,914, 4,216,553, 4,819,276 and 6,745,417, and U.S. Patent Application Publication No. 2006/0097189. However, these systems suffer from various of the deficiencies noted above. For example, it is typical with many of such systems to have dispensing occur with every toilet lid movement, regardless of need.

It can therefore be seen that improvements are desired with respect to toilet bowl cleaning devices that dispense toilet bowl treatment chemicals.

SUMMARY OF THE INVENTION

In one aspect, the invention provides a toilet bowl cleaning device including a plurality of solid tablets stored in a stacked configuration in a tablet dispenser so as to be dispensable from the dispenser. The tablets can include one or more components that perform cleaning and/or disinfecting and/or deodorizing functions in the toilet bowl and/or the toilet tank. By the term "tablet", it is intended to mean a solid mass of a size larger than what would be viewed as powder, regardless of shape. Hence, the tablets may be disk shaped, or spherical, or elongated, or have other configurations. The tablets preferably will be supplied in a refill unit which can be separated from the dispenser when the tablets have all been dispensed from the dispenser. The solid tablets can be stored in the dispenser in a stack with adjacent tablets abutting each other in face-to-face fashion.

In one aspect, the invention provides a device for dispensing a toilet treatment chemical to a toilet bowl. The device includes: (i) a cover (e.g. the toilet lid or seat) suitable to be pivotably mounted to a rearward portion of the toilet bowl so as to pivot between a somewhat upright position and an essentially horizontal position; (ii) a dispenser mounted to the cover; (iii) a plurality of solid tablets stored in the dispenser so as to be dispensable therefrom, wherein at least one of the tablets includes a toilet treatment chemical; and (iv) an actuator for moving a tablet from a ready position of the dispenser into the toilet bowl. The cover can be a toilet seat or a toilet lid.

The actuator moves the tablet from the ready position of the dispenser into the toilet bowl in response to a manual force having been applied to the actuator. The actuator can be linked to a return spring such that after a tablet is moved from the ready position of the dispenser into the toilet bowl the spring will cause the actuator to move back to a rest position. The actuator can include a slide for driving the tablet from the ready position of the dispenser into the toilet bowl. The actuator can include a button accessible at a top surface of the cover. In one form, the cover includes a delivery slot, and the actuator moves the tablet from the ready position of the dispenser through the delivery slot and into the toilet bowl. The actuator can include a lock which inhibits use of the actuator when the cover is in the upright position.

In another aspect, the invention provides a handheld device for dispensing a toilet bowl treatment tablet into the toilet bowl. The device includes a body having a cover and a hollow wall connected to the cover. The cover and the wall define an interior space in the body, and the cover includes a dispensing slot. The device also includes a removable tablet holder suitable for holding a plurality of solid tablets. The tablet holder can be provided as a refill unit. At least one of the tablets can include a toilet treatment chemical. The tablet holder is dimensioned to fit within the interior space of the body. The tablet holder has a tablet retainer at a dispensing end of the tablet holder, and the tablet retainer is located within the cover when the tablet holder is installed within the space of the body. The tablet retainer retains a tablet in a ready position for dispensing. The device also includes an actuator disposed in the cover. The actuator is suitable for moving a tablet from the ready position out through the dispensing slot.

In one form, the tablet retainer includes opposed elastic arms for retaining a tablet in the ready position for dispensing. At least one of the arms can include an inwardly directed flange for preventing movement of a tablet longitudinally beyond the flange. The tablet retainer can include a notch, and the actuator can include a slide dimensioned to be movable into the notch for pushing a tablet from the ready position out through the dispensing slot. The actuator can include a button arranged in a surface of the cover. The actuator can move the tablet from the ready position out through the dispensing slot in response to a manual force having been applied to the actuator by a user. The actuator can be linked to a return spring such that after a tablet is moved from the ready position out through the dispensing slot the spring will cause the actuator to move back to a rest position.

In one form, the tablet holder includes a locking mechanism for holding the tablet holder within the space of the body. The locking mechanism can include a pin attached to an outer surface of the tablet holder and a throughhole in a section of the wall of the body. The throughhole receives the pin in a mating locking connection. The section of the wall of the body having the throughhole is movable with respect to the wall of the body to assist in mating the pin and the throughhole.

In yet another aspect, the invention provides a refill unit for a device for dispensing a tablet wherein the dispensing device includes a body having a cover and a hollow wall connected to the cover, and an actuator disposed in the cover. The cover and the wall of the dispensing device define an interior space in the body, and the cover includes a dispensing slot. The actuator is suitable for moving a tablet from a ready position within the cover out through the dispensing slot of the dispensing device. The refill unit includes a housing suitable for holding a plurality of solid tablets, and a tablet retainer connected to the housing at a dispensing end of the housing. The tablet retainer is suitable for retaining a tablet in a ready position for dispensing. The housing and the tablet retainer of the refill unit are dimensioned to fit within the interior space of the body of the dispensing device, and the housing and the tablet retainer of the refill unit are dimensioned such that tablet retainer is located within the cover of the dispensing device when the refill is installed within the space of the body of the dispensing device.

In one form of the refill unit, the tablet retainer includes opposed elastic arms for retaining a tablet in the ready position for dispensing. At least one of the arms includes an inwardly directed flange for preventing movement of a tablet longitudinally beyond the flange. The tablet retainer can include a notch dimensioned for receiving the actuator such that a tablet may be moved by the actuator from the ready position out through the dispensing slot of the dispensing device. The housing of the refill unit can include a locking mechanism for the holding the tablet holder within the space of the body of the dispensing device. A plurality of tablets can be stored in the housing of the refill unit, and at least one of the tablets comprises a toilet treatment chemical. The plurality of tablets can be stored in the housing in a stack with adjacent tablets abutting each other in face-to-face fashion. A spring can be used for biasing the tablets toward the tablet retainer of the refill unit.

In still another aspect, the invention provides a method for cleaning and/or disinfecting and/or deodorizing a toilet bowl. The method uses a handheld device including a body, a tablet holder, and an actuator. The body has a cover and a hollow wall connected to the cover. The cover and the wall define an interior space in the body, and the cover includes a dispensing slot. The tablet holder holds a plurality of solid tablets. The tablet holder is located within the interior space of the body, and the tablet holder retains a tablet in a ready position within the cover for dispensing. The actuator is disposed in the cover, and is suitable for moving a tablet from the ready position out through the dispensing slot. A user applies a manual force to the actuator to move a tablet from the ready position out through the dispensing slot and into the toilet bowl where the tablet dissolves to clean and/or disinfect and/or deodorize the toilet bowl.

The foregoing and other advantages of the present invention will become apparent from the following description. In that description reference will be made to the accompanying drawings which form a part thereof, and in which there is shown by way of illustration example embodiments of the invention. The example embodiments do not limit the full scope of the invention.

DETAILED DESCRIPTION OF THE INVENTION

Figure 1:
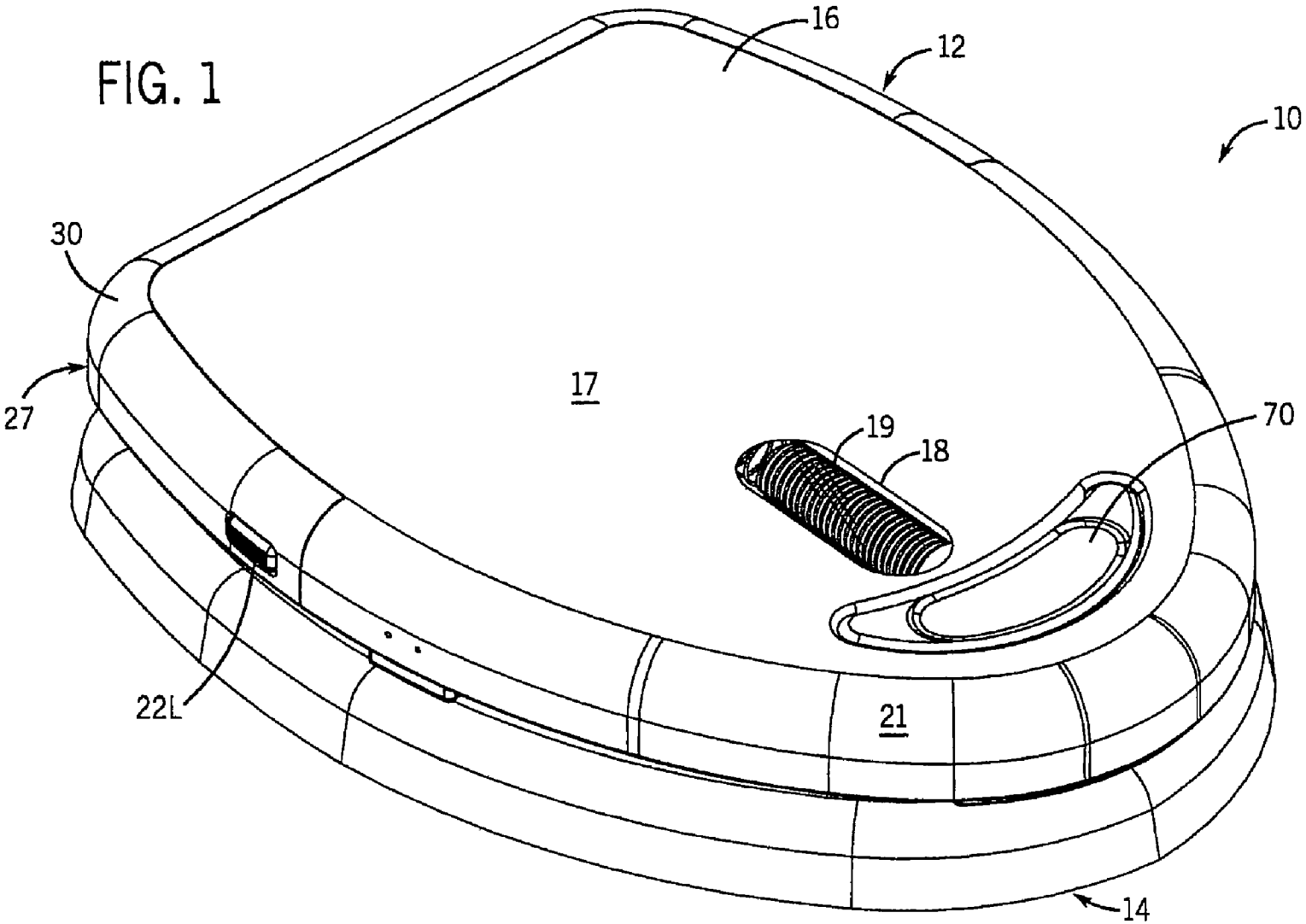
FIG. 1 is a top, front, left perspective view of an embodiment of a dispensing device according to the invention integrated into a toilet lid resting on a toilet seat.

Turning first to FIGS. 1 to 5, there is shown a dispensing device 10 according to a first example embodiment of the invention. The dispensing device 10 is integrated into a toilet lid 12 resting on a toilet seat 14. The toilet lid 12 and the toilet seat 14 are pivotably mounted in a conventional manner to a rearward portion of a toilet bowl (not shown) so as to pivot between a somewhat upright position and an essentially horizontal position on the rim of the toilet bowl. The toilet lid 12 shown is generally oval shaped. However, the invention is not limited to oval shaped lids. Other shapes for the lid (e.g. more round) are also suitable.

Looking at FIG. 2, the toilet lid 12 includes a separate top section 16 having a top surface 17 that may optionally include a transparent window 18 for viewing toilet treatment tablets 19 that are dispensed to the toilet bowl as described below. The window 18 helps show when the tablets 19 need to be replaced. The top section 16 of the toilet lid 12 has a downwardly directed curved forward wall 21 having opposed elastic mounting tabs 22L, 22R at the rear of the forward wall 21. A mounting rib 23 is at the rear of the top section 16, and an arcuate opening 24 with a downwardly directed support wall 25 with openings 26 is provided at the front portion of the top surface 17 of the top section 16 of the toilet lid 12.

Figure 2:
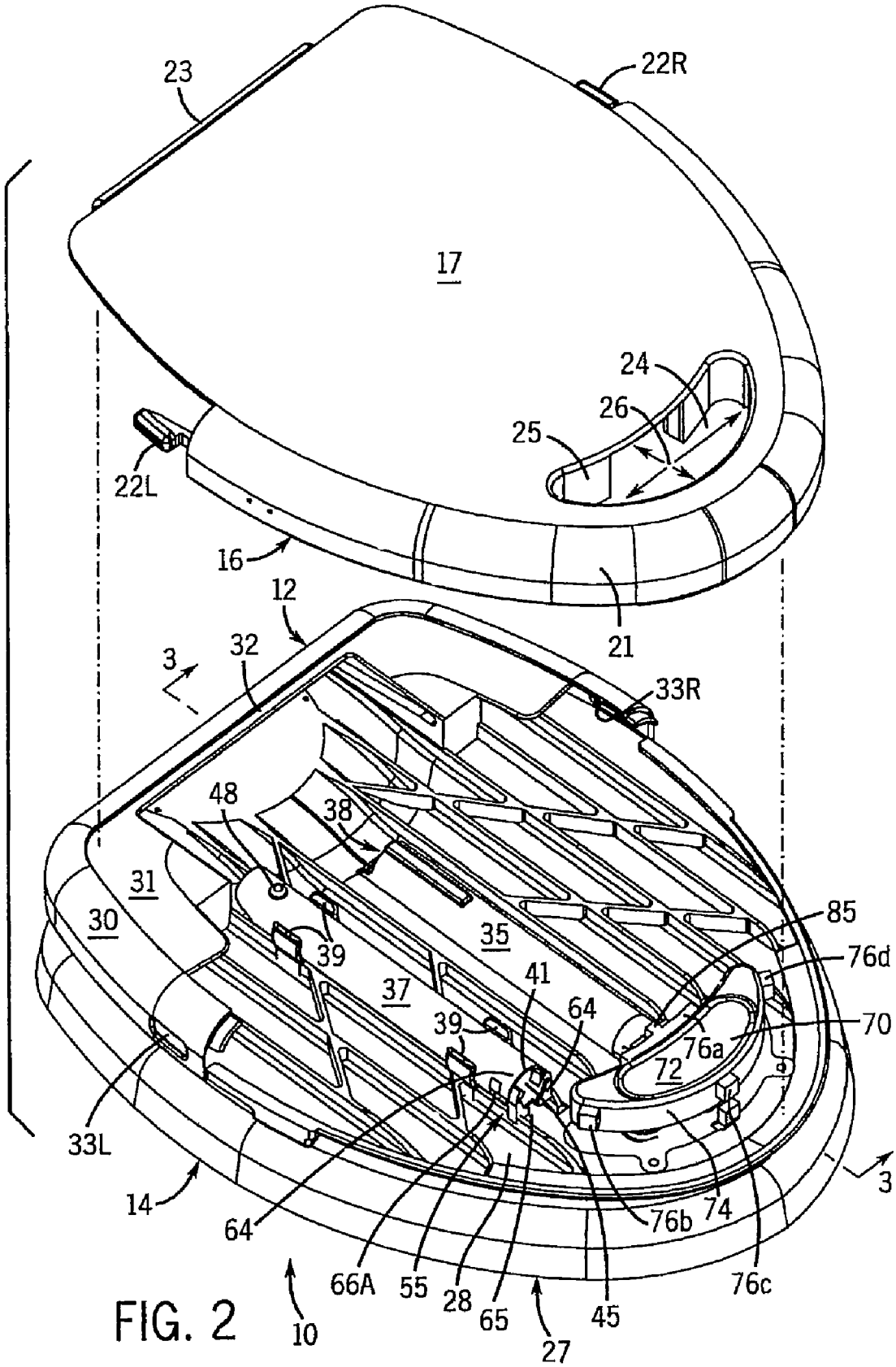
FIG. 2 is exploded perspective view of the device of FIG. 1 showing a top section of the toilet lid removed from a base section of the toilet lid.

Still referring to FIG. 2, the toilet lid 12 includes a separate base section 27 that rests on the toilet seat 14. The base section 27 includes a bottom wall 28 and a curved rear wall 30 that extends upwardly from the bottom wall 28. The bottom wall 28 includes a rectangular dispensing slot 29. The rear wall 30 includes an inwardly directed flange 31 that creates a space 32 at the rear of the base section 27. The rear wall 30 that opposed mounting holes 33L, 33R at the forward ends of the rear wall 30. The top section 16 of the toilet lid 12 is installed on the base section 27 by inserting mounting rib 23 in the space 32 and inserting the mounting tabs 22L, 22R in the mounting holes 33L, 33R. The top section 16 of the toilet lid 12 is removed from the base section 27 by pushing mounting tabs 22L, 22R out of the mounting holes 33L, 33R and pulling forwardly and upwardly on the top section 16. The top section 16 and the base section 27 of the toilet lid 12 may be formed from a polymeric material such as polyethylene or polypropylene.

Looking at FIGS. 2-5, the base section 27 of the toilet lid 12 includes a tubular tablet dispenser housing 35 mounted to the bottom wall 28 of the base section 27 of the toilet lid 12. The tablet dispenser housing 35 receives a tablet bottle 37 containing the tablets 19 by way of open end 38 of the tablet dispenser housing 35. The base section 27 of the toilet lid 12 may hold two tablet bottles 37 at one time as shown in FIGS. 2-5, that is, one tablet bottle 37 may be installed in the tablet dispenser housing 35 and one tablet bottle 37 may be clipped to the bottom wall 28 of the base section 27 of the toilet lid 12 by way of clips 39. In this configuration, when the last tablet 19 in the tablet bottle 37 in the tablet dispenser housing 35 is dispensed into the toilet bowl, the tablet bottle 37 in the tablet dispenser housing 35 can be removed and the tablet bottle 37 held by clips 39 can be inserted in the tablet dispenser housing 35.

The tablet bottle 37 includes a transparent tubular outer wall 41 that is closed off at one end by bottom wall 43. The opposite end of the outer wall 41 is open end 45. A finger indent 47 for ease of handling the tablet bottle 37 is below bottom wall 43 of the outer wall 41. A mounting protrusion 48 is provided on an outer surface of the outer wall 41 of the tablet bottle 37. The outer wall 41 may be formed from a polymeric material such as polyethylene or polypropylene.

The tablets 19 are held in the tablet bottle 37 between a compression spring 49 and a tablet retainer 55 which partially covers the open end 45 of the tablet bottle 37. The tablet retainer 55 may be formed from an elastic material such as nylon or acetal. The tablet retainer 55 has a curved body 56 with arms 58*a*, 58*b* that terminate in ends 59*a*, 59*b* that define an open spacing 61 between the ends 59*a*, 59*b* of the tablet retainer 55. Inwardly directed flanges 63*a*, 63*b*, 63*c*, 63*d* are located at the end 64 of the tablet retainer 55. A notch 65 is located in the end 64 opposite the spacing 61. Mounting arms 66*a*, 66*b* (not shown) hold the tablet retainer 55 on the open end 45 of the tablet bottle 37. Looking at FIGS. 3-5, it can be seen that the spring 49 biases a stack of the tablets 19 away from the bottom wall 43 of the tablet bottle 37 toward the tablet retainer 55. The arms 58*a*, 58*b* and the flanges 63*a*, 63*b*, 63*c*, 63*d* of the tablet retainer 55 hold an end tablet 19*e* of the stack in a ready position for dispensing, which is explained below.

A full stack of tablets may include any number of tablets depending on the size of the tablets 19 and the size of the tablet bottle 37. For example, thirty tablets could be provided in a full stack for a thirty day supply of once a day tablets. While the solid tablets 19 are shown being stored in the tablet bottle 37 in a stack with adjacent tablets 19 abutting each other in face-to-face fashion, the tablets can also be stored in an edge-to-edge orientation. Also, the tablets can be any shape, with circular disc tablets being preferred. The tablets can include various components such as cleaners (e.g., anionic, non-ionic, cationic, amphoteric and zwitterionic surfactants), disinfectants (e.g., chlorinating agents), and deodorizers (e.g., zinc ricinoleate).

Referring to FIGS. 1-5, the dispensing device 10 includes an actuator 68 for moving a tablet 19 from a ready position of the dispensing device 10 into the toilet bowl. The actuator 68 includes an arcuate push button 70 having a top wall 72 and a side wall 74 that depends downwardly from the top wall 72. Protrusions 76*a*, 76*b*, 76*c*, 76*d* extend outward from the side wall 74 of the button 70. The button 70 may be formed from a polymeric material such as polyethylene or polypropylene.

The button 70 is slidingly arranged in the opening 24 of the top section 16 of the toilet lid 12. Each of the protrusions 76*a*, 76*b*, 76*c*, 76*d* of the button 70 are placed in a mating opening 26 in the support wall 25 (see FIG. 2) to guide the each of the protrusions 76*a*, 76*b*, 76*c*, 76*d* in an associated opening 26 in the support wall 25. Looking at FIGS. 4 and 5, compression springs 78*a*, 78*b* are arranged between a bottom surface 79 of the button 70 and a top surface 81 of the bottom wall 28 of the base section 27 of the toilet lid 12. The compression springs 78*a*, 78*b* bias the button 70 upward. The button 70 also includes a slide 85 that protrudes outwardly from the protrusion 76*a*. The actuator can also comprise other configurations. For example, the actuator can include spaced apart separate buttons that both need to be pressed in order to deliver a tablet to the toilet bowl.

Figure 3:
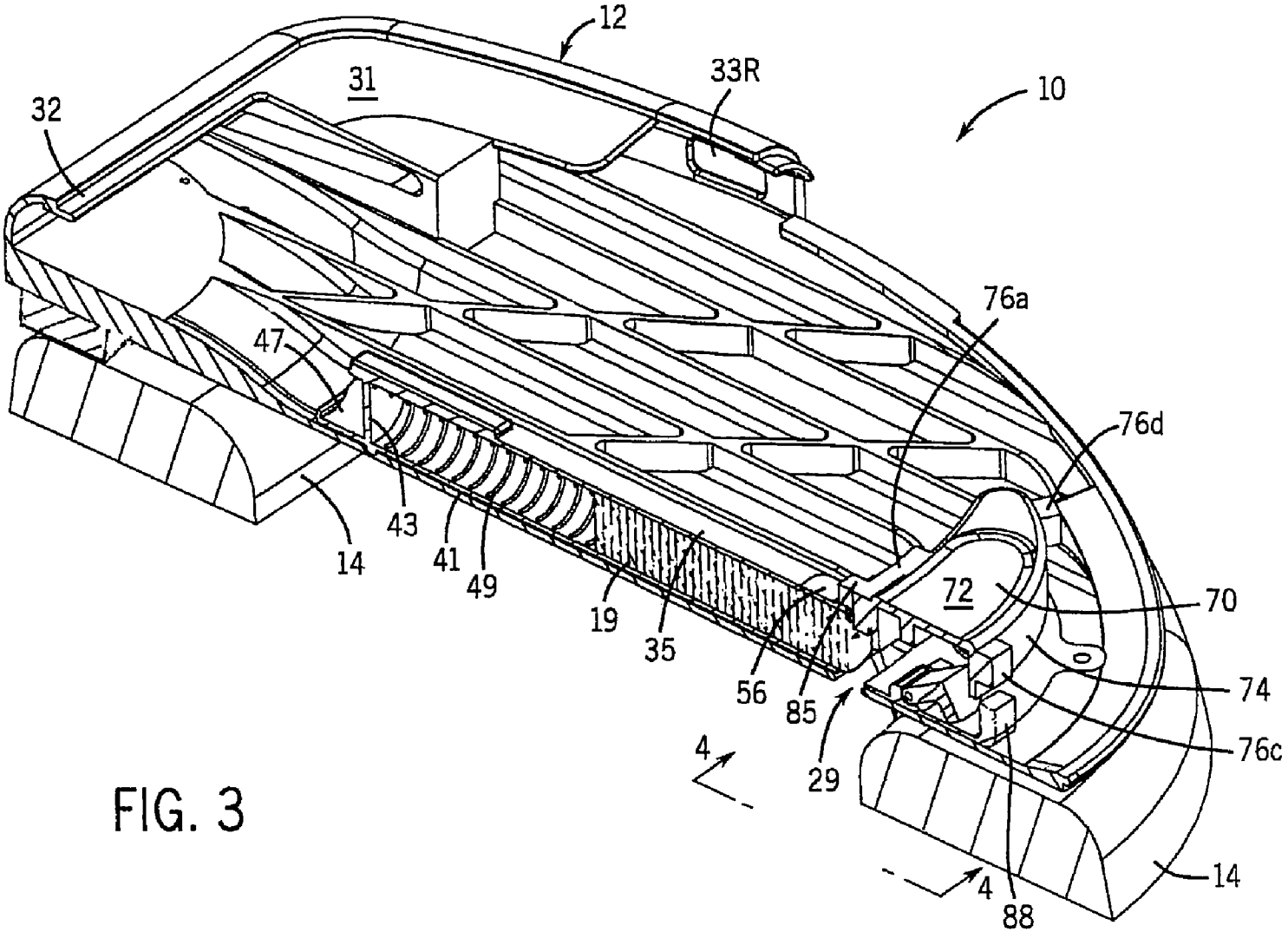
FIG. 3 is a cross-sectional view of the base section of the toilet lid of FIG. 2 taken along line 3-3 of FIG. 2.
Figure 4:
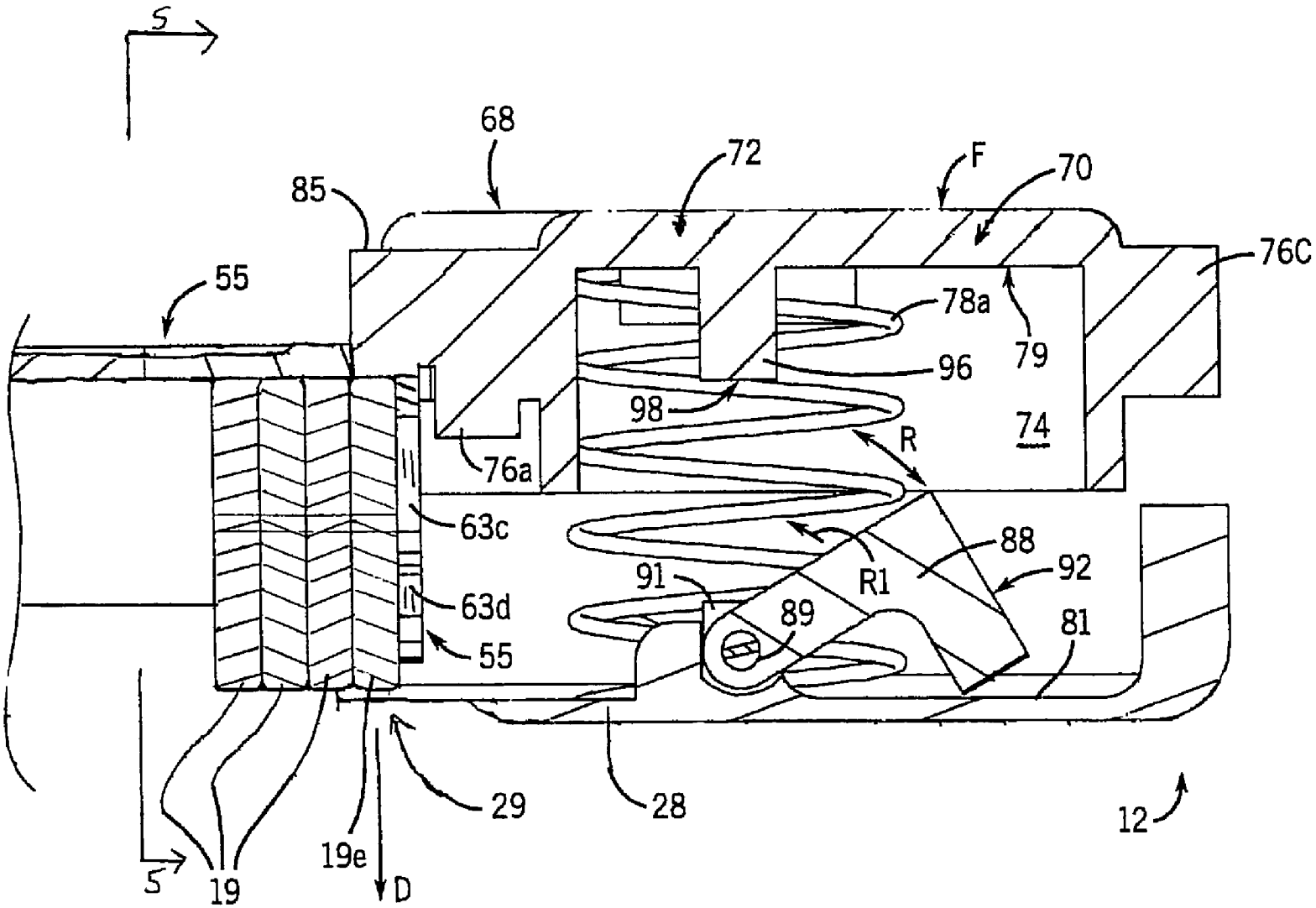
FIG. 4 is a detailed cross-sectional view of the tablet dispenser and actuator of the base section of the toilet lid of FIG. 3 with the toilet seat removed taken along line 4-4 of FIG. 3.

Looking at FIGS. 3 and 4, the top surface 81 of the bottom wall 28 of the base section 27 of the toilet lid 12 includes an inverted L-shaped lock 88 that pivots in direction R around a pivot pin 89 of a mounting bracket 91 on the top surface 81 of the bottom wall 28 of the base section 27 of the toilet lid 12. A top surface 92 of the lock 88 interfaces with a lower surface 98 of a stop 96 that depends downwardly from the top wall 72 of the button 70.

Having described the parts of the dispensing device 10, its operation can be explained further. The top section 16 of the toilet lid 12 is removed from the base section 27 by pushing mounting tabs 22L, 22R out of the mounting holes 33L, 33R and pulling forwardly and upwardly on the top section 16. A user then inserts a tablet bottle 37 into the open end 38 of the tablet dispenser housing 35. The tablet bottle 37 is inserted with the tablet retainer 55 going into the open end 38 first. The finger indent 47 provides for ease of handling of the tablet bottle 37. Mounting protrusion 48 of the tablet bottle 37 engages a recess on the base section 27 of the toilet lid 12 to retain the tablet bottle 37 in the tablet dispenser housing 35. The top section 16 of the toilet lid 12 is then installed on the base section 27 by inserting mounting rib 23 in the space 32 and inserting the mounting tabs 22L, 22R in the mounting holes 33L, 33R.

Figure 5:
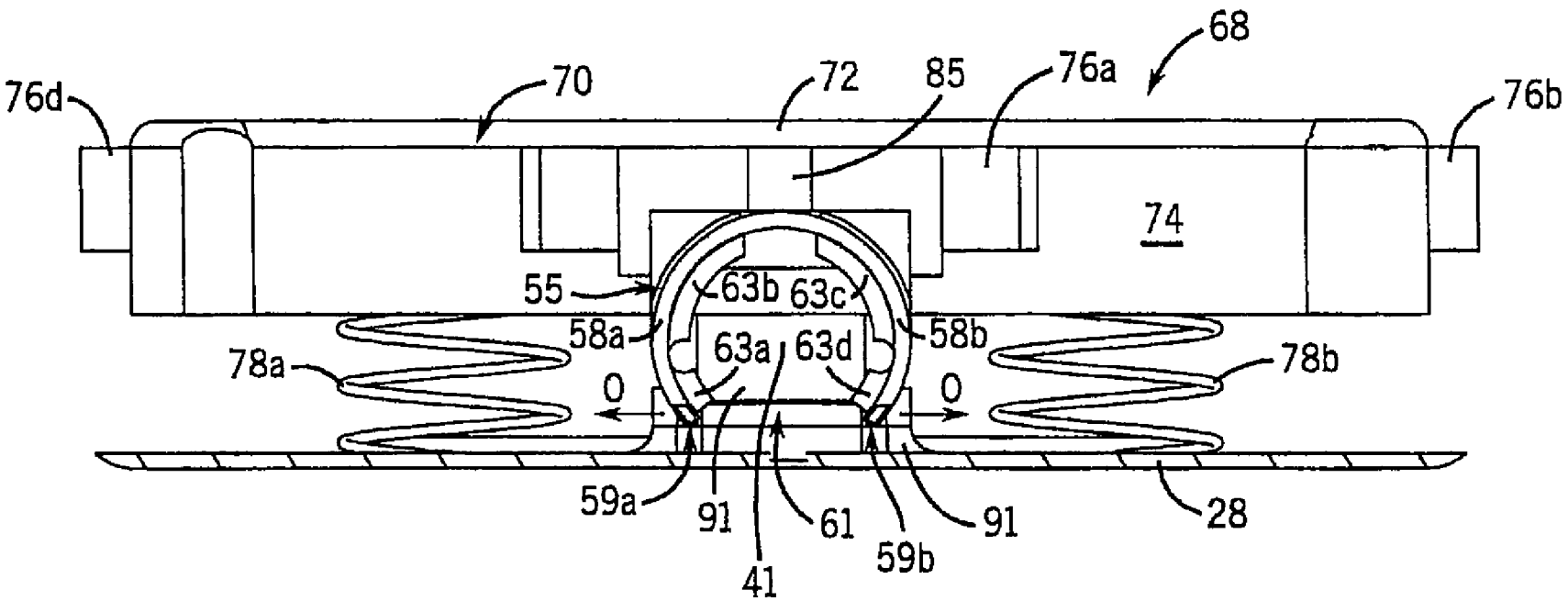
FIG. 5 is a detailed view of the tablet dispenser and actuator of FIG. 4 taken along line 5-5 of FIG. 4.

Looking at FIGS. 3-5, the spring 49 biases the stack of the tablets 19 against the tablet retainer 55. The arms 58*a*, 58*b* and the flanges 63*a*, 63*b*, 63*c*, 63*d* of the tablet retainer 55 hold an end tablet 19*e* of the stack in a ready position for dispensing. A user applies a downward force F on the top wall 72 of the button 70 (see FIG. 4) overcoming the biasing force of springs 78*a*, 78*b*, and slide 85 of the button 72 moves downward in notch 65 of the tablet retainer 55. The slide 85 moves tablet 19*e* downward in direction D (see FIG. 4) and elastic arms 58*a*, 58*b* move in directions O in FIG. 5 thereby releasing tablet 19*e* downward through rectangular dispensing slot 29 in the bottom wall 28 of the base section 27 of the toilet lid 12 and into the toilet bowl. The user then releases the downward force F on the button 70 and the button 70 returns to the rest position shown in FIG. 4 because of the upward biasing force of the springs 78*a*, 78*b*. The spring 49 in the tablet bottle 37 then moves the stack of tablets 19 toward the tablet retainer 55 such that the next tablet in the stack is now the end tablet 19*e* of the stack in a ready position for dispensing.

In certain positions of the toilet lid 12, the button 70 is prevented from being pushed. In the view of FIG. 4, the toilet lid 12 is in an essentially horizontal position, and the top surface 92 of the lock 88 is clear of the lower surface 98 of the stop 96 such that button 70 can be depressed using a downward force F. However, when the toilet lid 12 is raised into a somewhat upright position, the lock 88 rotates in direction R1 of FIG. 4 until the top surface 92 of the lock 88 is placed adjacent or in contact with the lower surface 98 of the stop 96. When the top surface 92 of the lock 88 is adjacent or in contact with the lower surface 98 of the stop 96*a* and a user presses the button 70 using a downward force F downward motion is inhibited due to the lock 88 blocking the stop 96. Thus, the button 70 is locked when the toilet lid 12 is open in a somewhat upright position, and as the toilet lid 12 is closed, the lock 88 releases by rotating away from the stop 96.

Turning now to FIGS. 6 to 11, there is shown a handheld dispensing device 110 according to a second example embodiment of the invention. The dispensing device 110 has a tubular body 112 having an outer wall 114 with an upper end 116 and a lower end 118. A lower opening 120 is provided at the lower end 118 of the body 112. A pair of slots 122 in the lower end 118 of the body 112 define a tab 124 that can flex inward and outward. The tab 124 has a throughhole 126. The outer wall 114 has ribs 128 that provide a hand grip for the fingers of a user. The body 112 may be formed from a polymeric material such as polyethylene or polypropylene.

The dispensing device 110 also has a cover 133 that along with the outer wall 114 of the body 112 defines an interior space 135 of the body 112. The cover 133 has a top wall 139, and a side wall 141 that extends downwardly from the top wall 139. A dispensing slot 143 is provided in the side wall 141. A bottom section 145 of the cover 133 is attached to the upper end 116 of the body 112. The top wall 139, the side wall 141 and the bottom section 145 of the cover 133 define an interior space 147 of the cover 133. The cover 133 may be formed from a polymeric material such as polyethylene or polypropylene.

The dispensing device 110 also has removable tablet holder 150. The tablet holder 150 can be sold as a refill unit. The tablet holder 150 includes a bottom wall 151 and a tubular side wall 153 that extends upwardly from the bottom wall 151. The side wall has a pin 154 that extends outwardly from the side wall 153. The tablet holder 150 has a handle 156 and a finger indent 158 for ease of handling the tablet holder 150. The tablet holder 150 has a longitudinal axis A (see FIG. 6). The tablet holder 150 may be formed from an opaque or transparent polymeric material such as polyethylene or polypropylene.

At an end of the tablet holder 150 opposite the bottom wall 151, there is provided a tablet retainer 161 having a curved body 162 with arms 164*a*, 164*b* that terminate in ends 165*a*, 165*b* that define an open spacing 166 between the ends 165*a*, 165*b* of the tablet retainer 161. Inwardly directed flanges 168*a*, 168*b*, 168*c*, 168*d* are located on the tablet retainer 161. A notch 170 is located in the tablet retainer 161 opposite the spacing 166. Looking at FIG. 11, a spring 171 biases a stack of the tablets 172 away from the bottom wall 151 of the tablet holder 150 toward the tablet retainer 161. (In FIG. 11, the central tablets in the stack are not shown.) The arms 164*a*, 164*b* and the flanges 168*a*, 168*b*, 168*c*, 168*d* of the tablet retainer 161 hold an end tablet 172*e* of the stack in a ready position for dispensing, which is explained below.

The dispensing device 110 also includes an actuator 176 for moving a tablet 172 from a ready position of the dispensing device 110 into the toilet bowl. The actuator 176 includes a push button 178 arranged in the side wall 141 of the cover 133. The push button 178 has a side wall 179 and a slide 180 that extends away from the side wall 179. The push button 178 also has a skirt 182 that extends away from the side wall 179. The actuator 176 also includes a compression spring 185 positioned between an end section 186 of the skirt and shoulders 188*a*, 188*b* of the inside of the cover 133. The spring 185 biases the push button 178 away from the interior space 147 of the cover 133.

Figure 6:
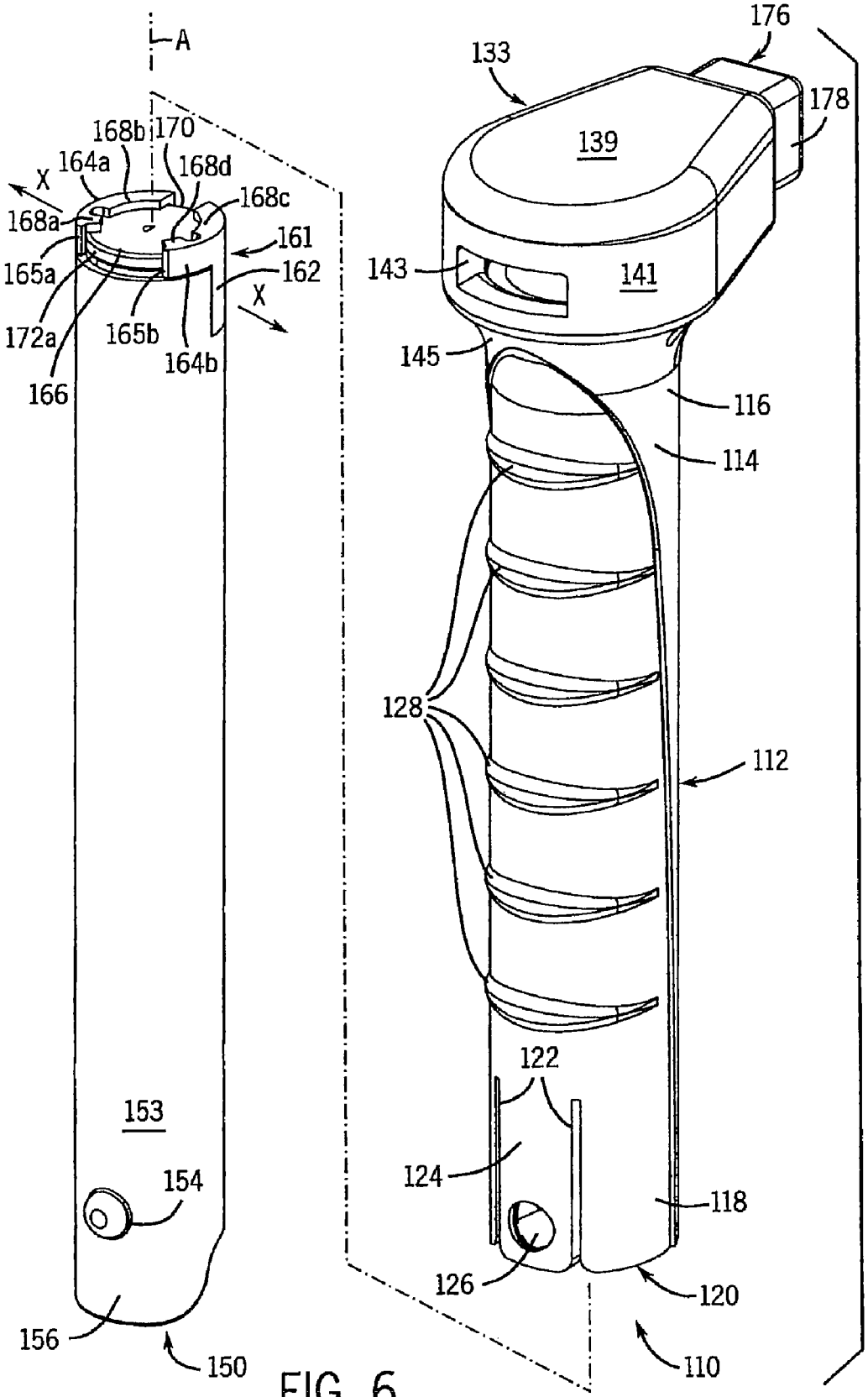
FIG. 6 is an exploded top, front, left perspective view of another embodiment of a dispensing device according to the invention showing a refill unit and the dispenser body.
Figure 7:
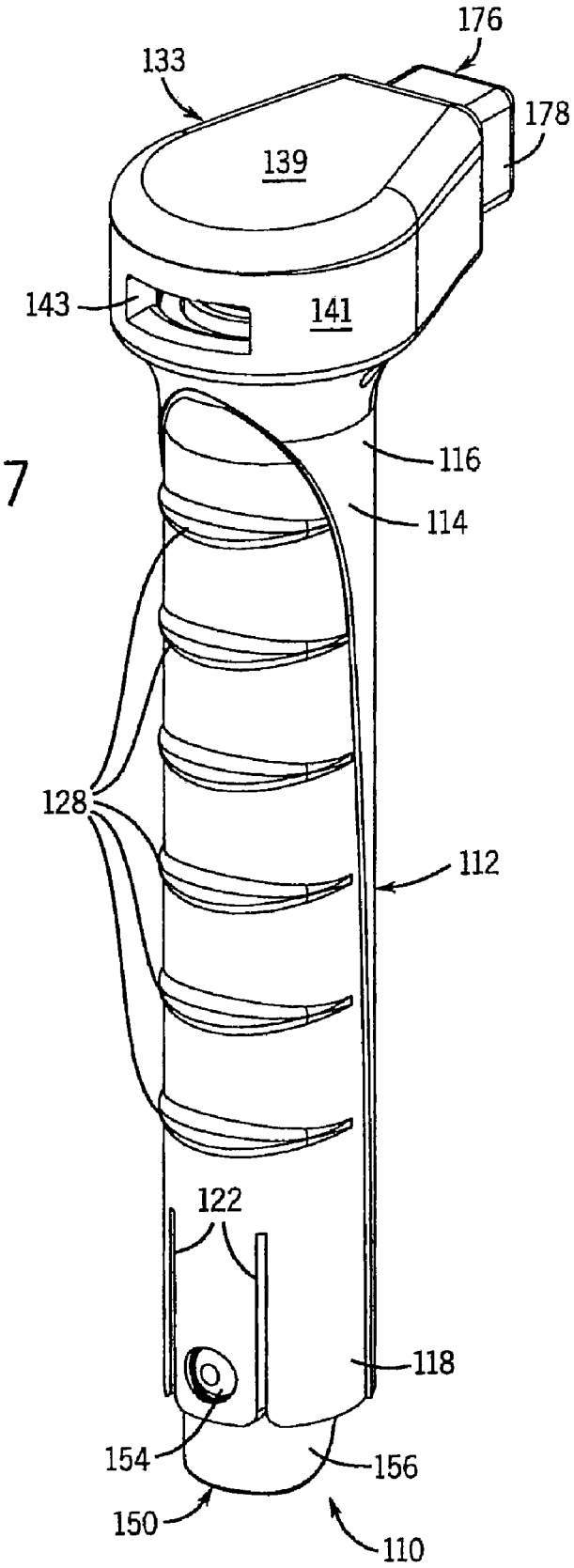
FIG. 7 is an exploded top, front, left perspective view of the dispensing device of FIG. 6 showing a refill unit installed in the dispenser body.
Figure 8:
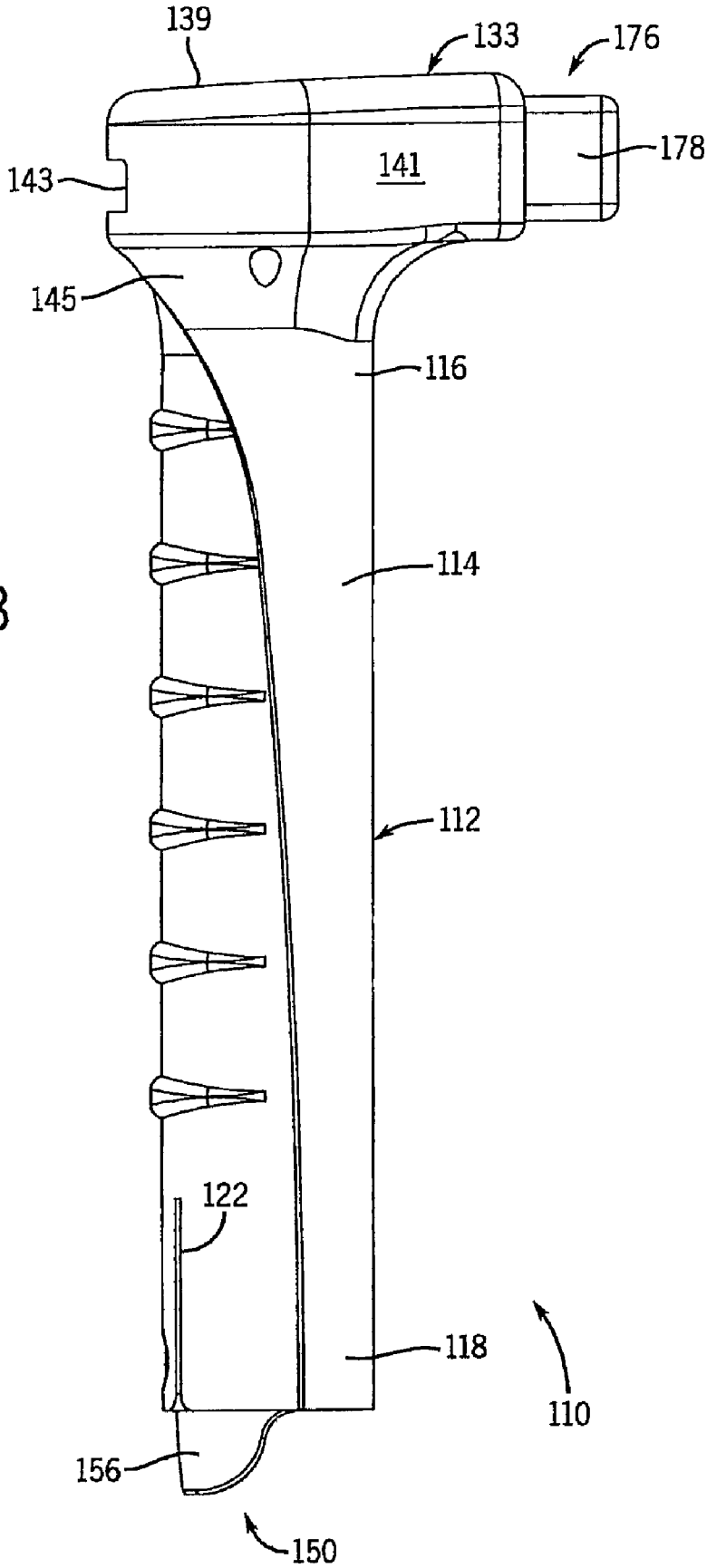
FIG. 8 is a front view of the dispensing device of FIG. 7.
Figure 9:
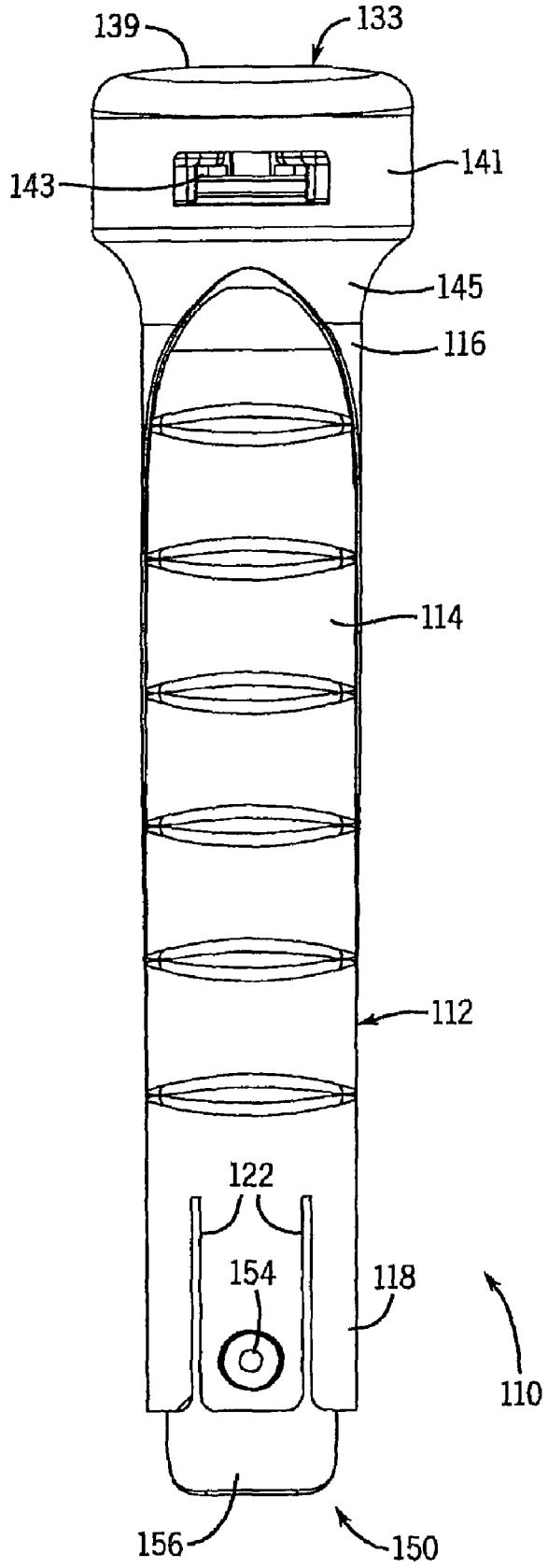
FIG. 9 is a left side view of the dispensing device of FIG. 7.
Figure 10:
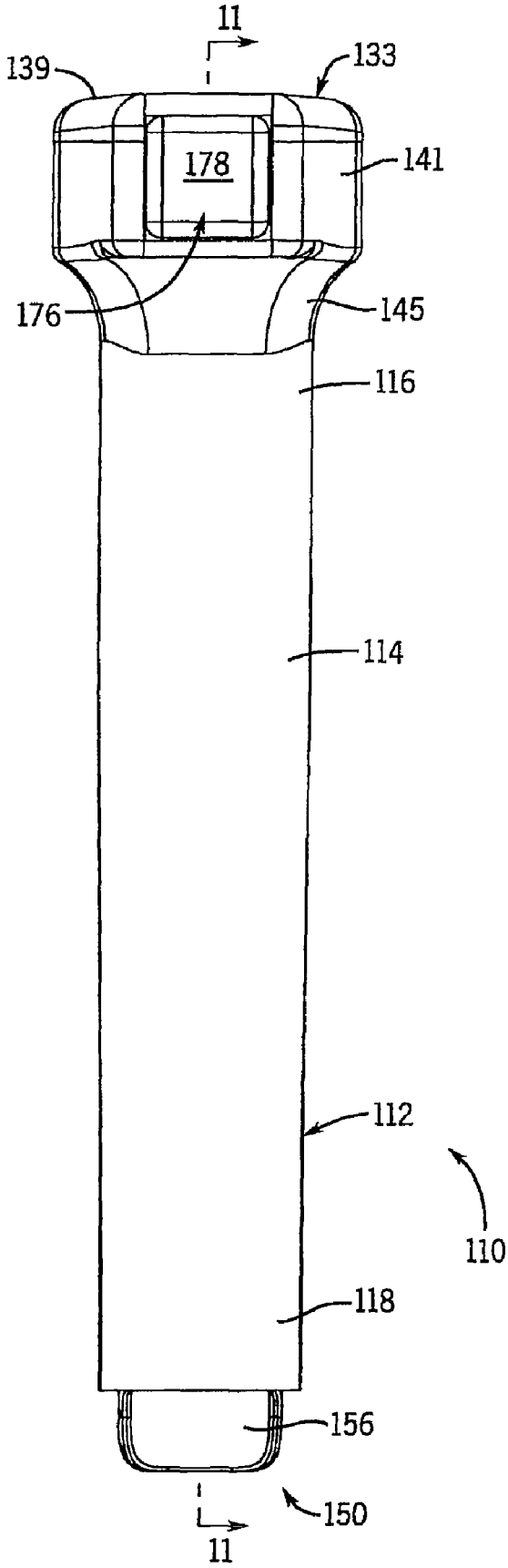
FIG. 10 is a right side view of the dispensing device of FIG. 7.

Having described the parts of the dispensing device 110, its operation can be explained further. A user inserts the tablet holder 150 into the lower opening 120 at the lower end 118 of the body 112 as shown in FIG. 6. The pin 154 of the tablet holder 150 enters the throughhole 126 of the body 112 to retain the tablet holder 150 in the body 112 (see FIG. 7).

Figure 11:
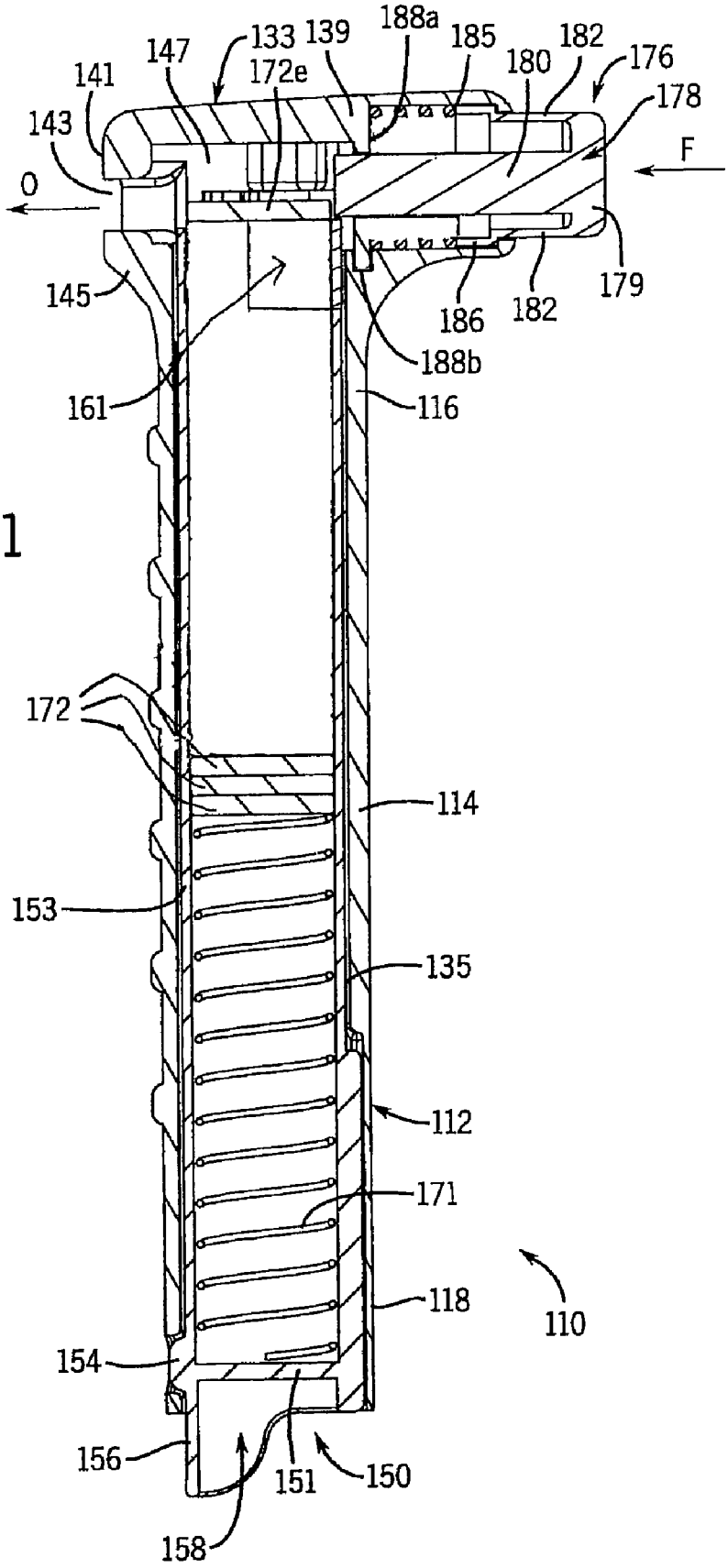
FIG. 11 is a cross-sectional view of the dispensing device of FIG. 7 taken along line 11-11 of FIG. 10.

Looking at FIG. 11, the spring 171 biases the stack of the tablets 172 against the tablet retainer 161. The arms 164*a*, 164*b* and the flanges 168*a*, 168*b*, 168*c*, 168*d* of the tablet retainer 161 hold an end tablet 172*e* of the stack in a ready position for dispensing. A user applies a force F on the side wall 179 of the button 178 (see FIG. 11) overcoming the biasing force of spring 185 and slide 180 of the button 178 moves sideways in notch 170 of the tablet retainer 161. The slide 180 moves tablet 172*e* in direction O (see FIG. 11) and elastic arms 164*a*, 164*b* move apart in directions X in FIG. 6 thereby releasing tablet 172*e* sideways through dispensing slot 143 in the side wall 141 of the cover 133 and into the toilet bowl. The user then releases the force F on the button 178 and the button 178 returns to the rest position shown in FIG. 11 because of the outward biasing force of the spring 185. The spring 171 in the tablet holder 150 then moves the stack of tablets 172 toward the tablet retainer 161 such that the next tablet in the stack is now the end tablet 172*e* of the stack in a ready position for dispensing. The flanges 168*a*, 168*b*, 168*c*, 168*d* of the tablet retainer 161 prevent the end tablet 172*e* from moving longitudinally along axis A beyond the flanges 168*a*, 168*b*, 168*c*, 168*d*.

In another version of the invention, the handheld dispensing device 110 can be mounted to the underside of a toilet lid or toilet seat by using a fastener that mounts the tubular body 112 to the underside of the toilet lid or toilet seat. Non-limiting examples of fasteners include one or more clips on the underside of the toilet lid or toilet seat that engage the tubular body 112. In one configuration, the handheld dispensing device 110 can be mounted to the underside of the toilet lid or toilet seat with the dispensing slot 143 facing laterally from the center of the underside of the toilet lid or toilet seat and with the push button 178 facing laterally in a opposite direction from the center of the underside of the toilet lid or toilet seat.

Thus, the invention provides devices that allow a consumer to direct a toilet treatment tablet into the toilet bowl when a button is actuated. In one version of the invention, there is provided a device that incorporates a dispenser type unit in the top of a toilet lid and dispenses a tablet into the toilet when the lid is closed and a button is actuated. A stop prevents a tablet ejecting from any position (up or down) except when the lid is fully closed (down). The stop is positioned behind the actuator button in a way that it is assisted by gravity that when the toilet lid is up such that the safety stop renders the button inoperable. This prevents any chance of consumer contact whether it is an adult or an unattended child. As the lid is closed and is near to its bottom resting point, the safety stop rotates 90 degrees such that the dispenser will now allow a tablet to be ejected.

In another version of the invention, there is provided a hand held device that dispenses tablets. The device fits in a user's hand. To use, one takes aim in the toilet, and the thumb depresses the button to send a tablet into the toilet. The refill unit is accessed on the bottom by overcoming the locking pin on the side of the unit. The device could be stored in many places such as hanging off the side of the toilet reservoir, or on top of the reservoir. The device can also be mounted on the underside of the toilet lid or toilet seat during use.

The above description has been that of example embodiments of the present invention. It will occur to those that practice the art, however, that still other modifications may be made without departing from the spirit and scope of the invention. Hence, the scope of the invention should not be entirely judged by just the example embodiments.

INDUSTRIAL APPLICABILITY

The present invention provides dispensers that allow a consumer to direct a tablet into the toilet bowl when a button is actuated.

What is claimed is:

1. A device for dispensing a toilet treatment chemical to a toilet bowl, the device comprising:

a cover suitable to be pivotably mounted to a rearward portion of the toilet bowl so as to pivot between a somewhat upright position and an essentially horizontal position;

a dispenser mounted to the cover;

a plurality of solid tablets stored in the dispenser so as to be dispensable therefrom, wherein at least one of the tablets comprises a toilet treatment chemical; and an actuator for moving a tablet from a ready position of the dispenser to a release position adjacent the toilet bowl;

wherein the actuator is configured to move a tablet from the ready position of the dispenser to the release position when the cover is closed and the actuator is actuated;

the actuator being manually downwardly movable to achieve dispensing of the chemical after the cover is closed;

wherein the actuator is linked to a return spring such that after a tablet is moved from the ready position of the dispenser to the release position the return spring will cause the actuator to move back to a rest position while the cover is still closed.

2. The device of claim 1 wherein:

the actuator has a slide for driving the tablet from the ready position of the dispenser to the release position;

the cover has a delivery slot; and the actuator moves the tablet from the ready position of the dispenser through the delivery slot and to the release position.

3. The device of claim 1 wherein the actuator has a lock which inhibits use of the actuator when the cover is in the upright position.

4. The device of claim 1 wherein the plurality of solid tablets are stored in the dispenser in a stack with adjacent tablets abutting each other in face-to-face fashion in a refill unit which can be separated from the dispenser.

5. The device of claim 1 wherein the actuator includes a button arranged through a top surface of the cover.

* * * * *